US010384827B1

(12) United States Patent
Mehta et al.

(10) Patent No.: US 10,384,827 B1
(45) Date of Patent: Aug. 20, 2019

(54) GAPLESS PACKAGING WITH INTERNAL SUPPORT SYSTEM

(71) Applicant: Apple Inc., Cupertino, CA (US)

(72) Inventors: Bhautik H. Mehta, Mountain View, CA (US); Evan M. Rosebrock, San Francisco, CA (US); Mark T. Uyeda, Campbell, CA (US); Wayne H. Cowan, Santa Clara, CA (US); Connie Yang, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 5 days.

(21) Appl. No.: 15/701,199

(22) Filed: Sep. 11, 2017

(51) Int. Cl.
*B65D 81/05* (2006.01)
*B65D 5/50* (2006.01)
*B65D 81/133* (2006.01)

(52) U.S. Cl.
CPC ..... *B65D 5/5035* (2013.01); *B65D 81/057* (2013.01); *B65D 81/133* (2013.01); *B65D 2581/053* (2013.01)

(58) Field of Classification Search
CPC .... B65D 5/5035; B65D 5/503; B65D 81/057; B65D 81/133; B65D 81/05; B65D 81/1275; B65D 2581/053
USPC ..... 206/583, 565, 563, 562, 564, 756, 763, 206/521.2; 220/23.87, 23.83, 23.89
See application file for complete search history.

(56) References Cited

U.S. PATENT DOCUMENTS 5,040,678 A * 8/1991 Lenmark, Sr. ..... B65D 81/107 206/204
5,295,580 A * 3/1994 Hicks ..... B65D 5/5054 206/588
5,816,402 A * 10/1998 Weder ..... B65D 5/50 206/423
6,527,123 B1 * 3/2003 Ausaf ..... A47J 47/14 206/541
7,331,465 B2 * 2/2008 Parrington ..... B65D 77/003 206/583
7,494,015 B2 * 2/2009 Bacon ..... B65D 5/4204 206/320
D596,485 S * 7/2009 Andre ..... D9/737
7,878,326 B2 * 2/2011 Andre ..... B65D 25/10 206/320
8,109,389 B1 * 2/2012 Amer ..... B65G 5/5038 206/499
8,365,943 B2 * 2/2013 Bentley ..... B65D 81/3823 206/545

(Continued)

*Primary Examiner* — Steven A. Reynolds
(74) *Attorney, Agent, or Firm* — Sterne, Kessler, Goldstein & Fox P.L.L.C.

(57) ABSTRACT

A product with packaging includes a base box having sidewalls defining a cavity, a support structure having sidewalls disposed in the cavity, the support structure sidewalls being attached to corresponding walls of the base box. A tray is attached to the support structure and disposed in the cavity. An outer periphery of the tray is larger than an inner periphery of the cavity, such that the outer periphery of the tray presses against the inner periphery of the cavity resulting in a gapless interface between the two. An outer periphery the support structure is smaller than an inner periphery of the cavity, such that it results in a tension fit between the two that pulls the inner periphery of the cavity against the tray resulting in a gapless interface between the two.

20 Claims, 5 Drawing Sheets

(56) References Cited

U.S. PATENT DOCUMENTS

| | | | | |
|---|---|---|---|---|
| 8,997,984 | B2 * | 4/2015 | Kuo | B65D 51/20 206/320 |
| 9,738,424 | B2 * | 8/2017 | Korinek | B65D 43/0222 |
| 9,914,555 | B2 * | 3/2018 | Korinek | B65D 5/503 |
| 10,106,292 | B2 * | 10/2018 | Al-Khal | B65D 5/5038 |
| 2001/0020595 | A1 * | 9/2001 | Koike | B65D 81/025 206/521 |
| 2003/0102244 | A1 * | 6/2003 | Sanders, Jr. | B65D 5/22 206/523 |
| 2005/0167317 | A1 * | 8/2005 | Barrett | B65D 1/30 206/557 |
| 2006/0032777 | A1 * | 2/2006 | Russell | B65D 5/5035 206/521 |
| 2006/0138020 | A1 * | 6/2006 | Hubbs | A47F 5/11 206/764 |
| 2010/0187149 | A1 * | 7/2010 | Tsukii | B65D 5/5035 206/521 |
| 2013/0240395 | A1 * | 9/2013 | Hall | B65D 5/48038 206/433 |
| 2015/0375893 | A1 * | 12/2015 | Korinek | B65D 5/503 493/90 |
| 2018/0178965 | A1 * | 6/2018 | Tsai | B65D 5/6664 |

* cited by examiner

GAPLESS PACKAGING WITH INTERNAL SUPPORT SYSTEM

FIELD

The described embodiments relate generally to retail packaging. More particularly, the present embodiments relate to packaging using an internal support structure to achieve a gapless appearance between the walls of a box and a product-holding tray positioned along an inside periphery of a box.

SUMMARY

Some embodiments include packaging including a base box with a pair of opposing sidewalls spaced apart by a first free length (e.g., a distance between components that may change based on tension or compression being applied to the component in a non-free state). The packaging includes a molded-fiber tray disposed between the opposing sidewalls and below a top edge of the base box. The edges of the molded-fiber tray that are in contact with the opposing sidewalls are spaced apart by a second free length, and the second free length is greater than the first free length.

The packaging further includes a corrugated cellulose-based support structure disposed between the opposing sidewalls of the base box and supporting the tray which is fixed to it. The support structure includes opposing sidewalls spaced apart by a third free length, and the third free length is less than the first free length. The inner surfaces of the opposing sidewalls of the base box and the outer surfaces of the corresponding sidewalls of the support structure are fixed together such that the opposing sidewalls of the base box are pulled against the corresponding sidewalls of the support structure. This results in no gap between the outer periphery of the molded-fiber tray and the inner periphery of the base box, such that the interface between the peripheral edges of the tray and the sidewalls of the base box is gapless.

The support structure and tray may be formed of different materials (e.g., different cellulose-based material). For example, the tray may be made from molded fiber, and the support structure may be made from corrugated cardboard or greyboard. The support structure may include a pillar beneath a portion of the tray such that the tray is supported at the pillar and the tray's resistance to deflection is thereby increased. The tray and the base box wholly envelop the support structure such that it is not visible to a customer.

The support structure includes a top surface, and the tray is adhered to the top surface to fix it in relation to the base box. The support structure may include a pillar extending below a top surface of the support structure, the pillar being coupled to a lower surface of the base box such that the bending strength of the top surface of the support structure is increased.

An outer periphery of the tray is oversized with respect to an inner periphery of the cavity, such that it promotes a gapless interface between the two. An outer periphery of the support structure is undersized respect to an inner periphery of the cavity, such that it results in a tension fit between the two, and promotes a gapless interface between the outer periphery of the tray and the inner periphery of the cavity. The support structure comprises cutouts in the top surface from which the sidewalls extend such that they are configured to receive a pressing fixture to effect an adhesive bond between the sidewalls of support structure and sidewalls of the base box.

The tray may include a product recess to receive a second product, and the support structure may include a corresponding hole to accommodate the product recess when the tray is positioned above the support structure.

Some embodiments include a method of making a packaging. The method includes inserting a support structure into a cavity defined by the sidewalls of a base box. An outer periphery of the support structure is smaller than an inner periphery of the cavity, and the sidewalls of the support structure include pressure sensitive adhesive on their outer surfaces. The method includes positioning a fixture within holes in the support structure such that the fixture presses the sidewalls of the support structure and the sidewalls of the base box together this activates the pressure sensitive adhesive and secures the support structure and base box together. The method includes adhering a product tray to a top surface of the support structure, e.g., with a water-based adhesive. The outer periphery of the tray is larger than the inner periphery of the cavity, such that there is no gap between the outer periphery of the tray and the inner periphery of the cavity.

Advantageously, this improves upon prior systems having, for example, folded trays or bowed lower base boxes, which produce gaps between the components that may provide an unfinished or disjointed appearance. By designing the relative dimensions between the corresponding features of the base box, support structure, and tray, any potential product, assembly, or packaging tolerance issues still result in secure packaging having a gapless appearance.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
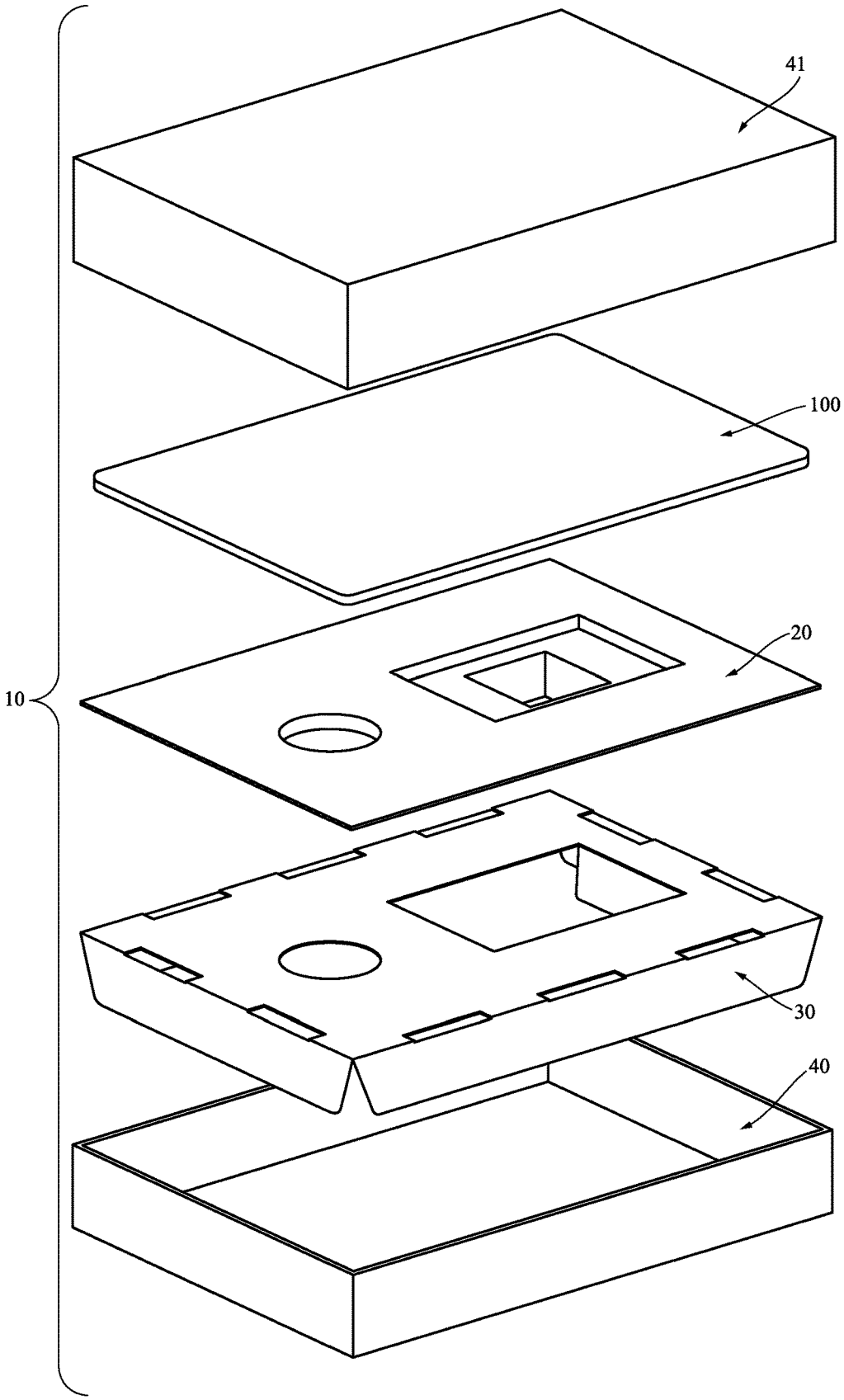
FIG. 1 shows an exploded view of packaging with a product.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Product packaging is an integral part of a customer's experience. It introduces the customer to their product, and can affect the customer's feelings toward the product and the company that created it. Seamless packaging without unnecessary gaps between edges and components—calling to mind a unitary construction with robust character—may be particularly desirable.

Packaging should be aesthetically appealing, but at the same time direct a customer's attention to the product it is designed to hold. Packaging having gaps, defects, or imperfections can draw the customer's attention away from the product it is holding or make the product seem less appealing. For example, if an interior tray designed to hold a product is placed inside of a lower half of a box, defects and gaps between the edges of the tray and box walls may present a disjointed appearance that detracts from the customer's experience.

In the same vein, companies may be sensitive to the cost of packaging and may wish to promote packaging that is eco-friendly. Certain packaging materials are higher cost due to their processing, and while engineers may be able to design single-component packaging, the cost may be prohibitive for certain materials. Optimization of packaging in material usage may help keep costs low, and if done well may not interfere with, and may promote, a positive user experience. Packaging made out of recyclable and/or biodegradable materials, such as paper or other cellulose-based products can reduce environmental impact. Packaging that is interesting in character and well-executed may boost a product's or a brand's reputation, thereby attracting new customers and retaining previous customers.

Packaging described in this document achieves these and other beneficial characteristics by balancing structural robustness, eco-friendly materials, and aesthetic elements. A base box receives a corrugated support structure. The outer periphery of the walls of the corrugated support structure is under sized for the inner dimensions between the base box walls. An assembly fixture may press the inner lower base box walls and the outer periphery of the walls of the corrugated support structure together, securing them to each other with adhesive. A molded-fiber top tray is then placed above the corrugated support structure, hiding the corrugated support structure from view of the end customer. The molded-fiber top tray presents a finished, clean, flawless appearance, and hides the unfinished raw appearance of the underlying corrugated support structure. The peripheral edges of the molded-fiber top tray are oversized for the inner dimensions between the base box walls, such that when the molded-fiber top tray is secured to the corrugated support structure, the peripheral edges press against the interior sides of the base box and so create no gaps along the walls of the base box.

To keep the product protected and secure during transport, handling, or storage, the molded-fiber top tray may include molded recesses or features to hold various components, documents, and products. A top lid covers the product and the molded-fiber top tray when the packaging is closed. The cooperation of the size and materials of the inner periphery of the base box, corrugated support structure, and molded-fiber top balance each of the aforementioned goals—including eco-friendliness, aesthetic design, structural robustness, cost, and ease of manufacturing.

The packaging may be retail packaging (i.e., finished packaging for containing and conveying a product to a user such as may be used in a retail setting, not shipping packaging for containing a packaged product during shipment) that one may expect to find on the shelf in a retail store, and which one may open after purchase to directly access their product. A product contained by the packaging may be, for example, an electronic device such as, for example, a laptop, tablet computer, or smartphone, or it may be a non-electronic device, such as, for example, a book.

These and other embodiments are discussed below with reference to the accompanying figures. However, those skilled in the art will readily appreciate that the detailed description given herein with respect to these figures is for explanatory purposes only and should not be construed as limiting.

FIG. 1 shows an exploded top perspective view of packaging 10 including a product 100 according to some embodiments of this invention. The packaging 10 includes a lid 41, a tray 20 (e.g., a molded-fiber tray), a support structure 30 (e.g., a corrugated support structure), and a base box 40. Base box 40 and lid 41 contain product 100 when base box 40 and lid 41 are dosed together. Molded-fiber tray 20 may be molded in three dimensions, e.g., not as a flat sheet.

Figure 2:
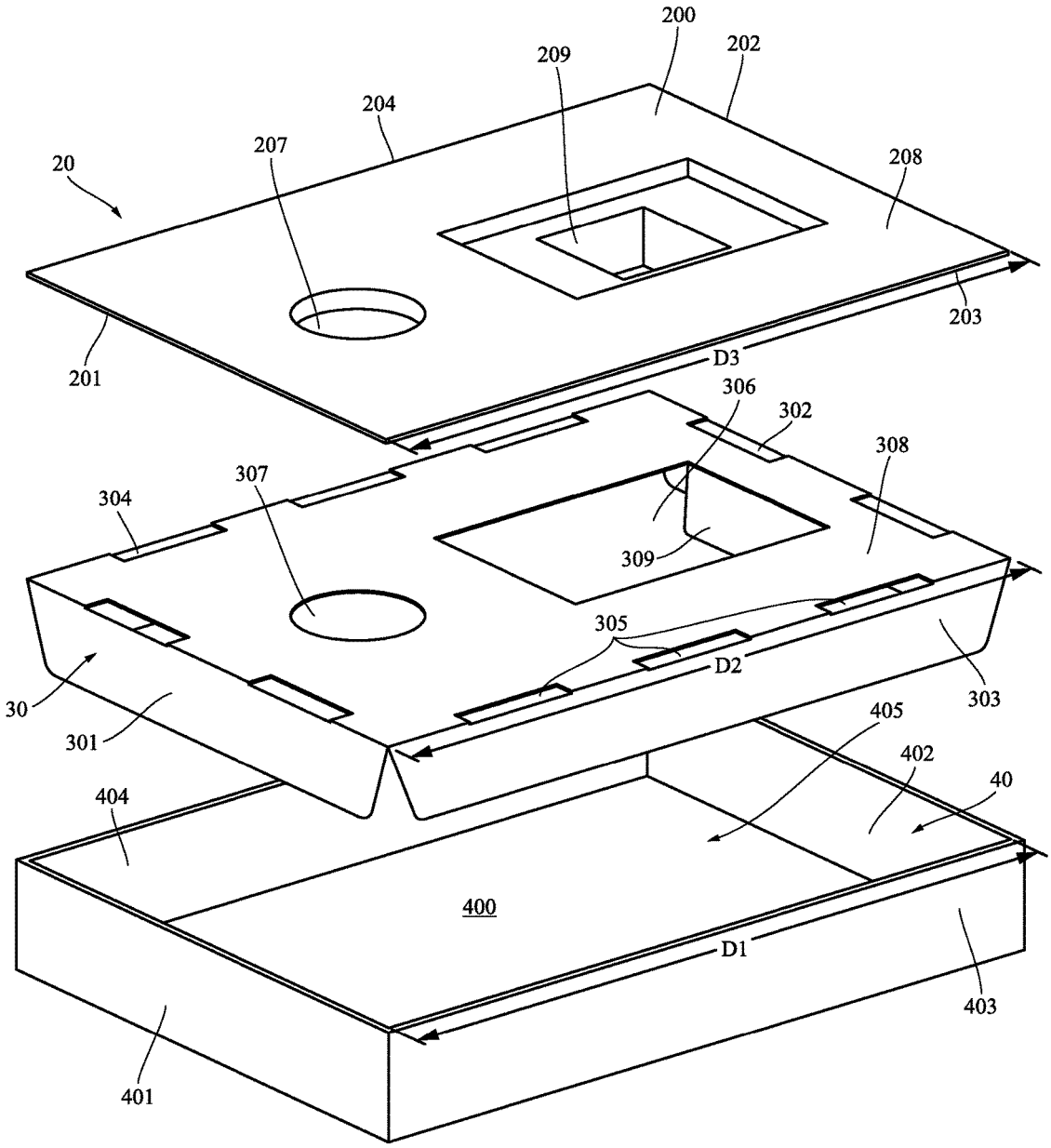
FIG. 2 shows an exploded view of a portion of the packaging shown in FIG. 1.
Figure 3:
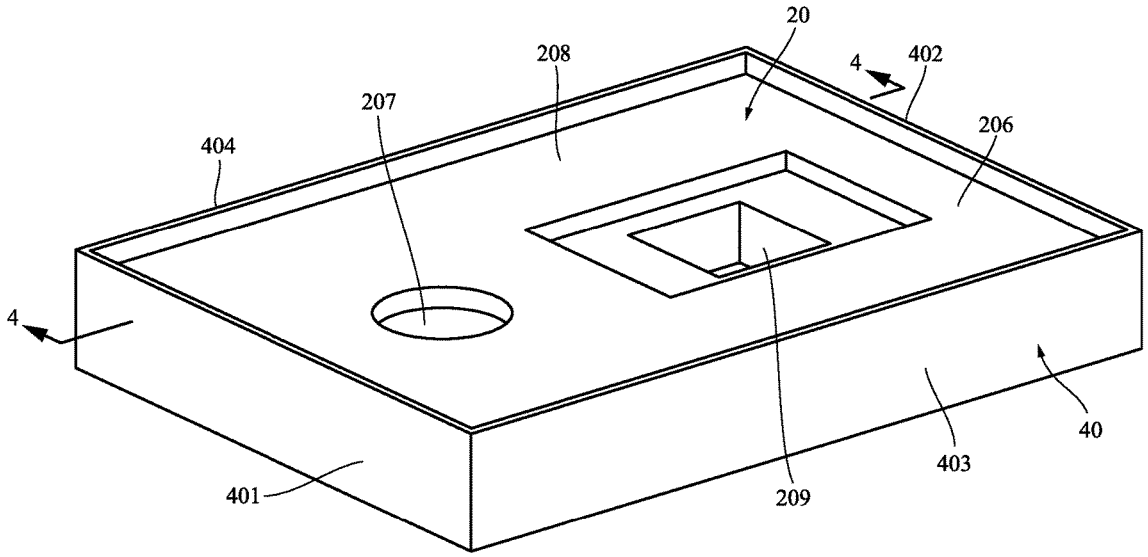
FIG. 3 shows an assembled view of the portion of the packaging shown in FIG. 2.

FIGS. 2 and 3 show exploded and assembled perspective views, respectively, of base box 40, support structure 30, and tray 20. As shown, base box 40 may include bottom surface 400 and vertical sidewalls 401, 402, 403, and 404. Together, these define cavity 405 within the inner sides of sidewalls 401/402/403/404 and bottom surface 400. Cavity 405 is configured to receive support structure 30 and tray 20 on top of support structure 30. The inner surfaces of sidewalls 401/402/403/404 correspond to the outer shape of support structure 30 and tray 20, such that the sidewalls are disposed immediately around the periphery of both. As shown in the figures, the base box 40 has a rectangular cuboid shape, though other shapes can also be used for it as well as the other packaging components.

Support structure 30 includes sidewalls 301, 302, 303, and 304, which correspond in position to the sidewalls of base box 40. Additionally, support structure may include holes 305, which are included to receive an assembly fixture for assembling the support structure 30 to base box 40 (as discussed below with reference to FIG. 5). Support structure 30 also includes openings 306 and 307, which correspond to features of tray 20 that are received in openings 306 and 307 when tray 20 is placed on top of support structure 30. Support structure 30 includes top surface 308, which serves as a mating surface between tray 20 and support structure 30. Additional supports may extend below from support structure 30 and give support structure 30 additional strength or rigidity (e.g., pillar members 309 may extend, for example from edges of openings 306, 307, and aid in strengthening support structure 30 towards the center of top surface 308). Support structure 30 imparts structural rigidity and strength to base box 40 and by extension, lid 41 when packaging 10 is closed. It also allows less material to be used in forming tray 20.

Figure 4:
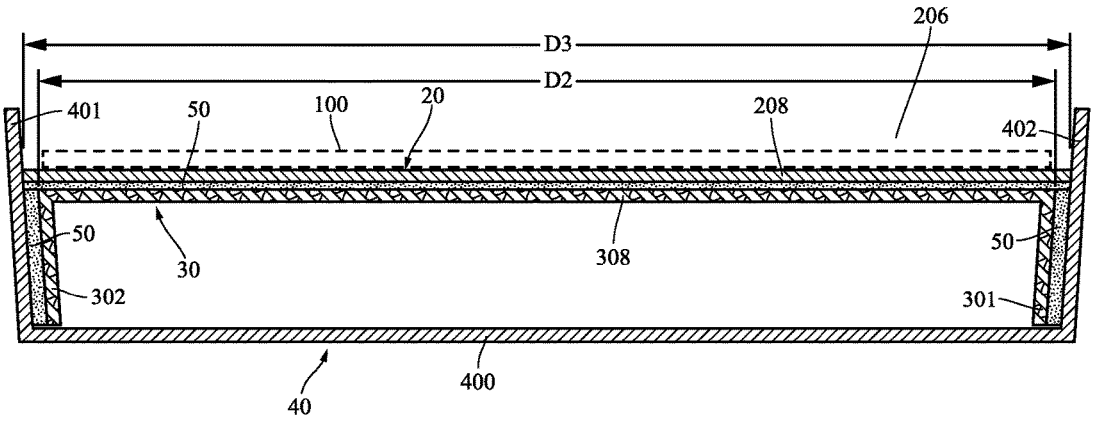
FIG. 4 shows a cross-sectional schematic view of the portion of the packaging along line 4-4.

Tray 20 includes peripheral edges 201, 202; 203, and 204, which correspond in position to the sidewalls of base box 40. Tray 20 includes a surface 200, the underside of which may be adhered to top surface 308 of support structure 30. Tray 20 includes top surface 208, which may be inset down a distance from upper edges of base box 40 sidewalls 401/402/403/404 and covered (e.g., by lid 41) when packaging 10 is closed. Top surface 208 may extend perpendicularly with respect to sidewalls 401/402/403/404. Tray 20 may include cavities 207 and 209, for example. As shown in FIGS. 3 and 4, cavity 206 may be configured to contain product 100, and may be formed by tray 20 and sidewalls 401/402/403/404. Tray 20 is adhered to support structure 30 to fix it in relation to base box 40, such that tray 20 is disposed below a top edge of base box 40 thereby forming cavity 206.

In some embodiments product 100 is constrained by cavity 206 and the underside of lid 41 when packaging 10 is closed. Removing product 100 also reveals, in some embodiments, an underlying cavity 209, which may contain a second product such as, for example, accessories or literature related to product 100. Product 100 may overlay cavity 209 when packaged, so as to cover cavity 209 and help secure and restrict movement of the second product. Additional cavity 207 may include a separate product, or may be configured simply as an aesthetic design.

A physical gap between tray 20 and sidewalls 401/402/403/404 is not aesthetically pleasing. As shown in FIG. 3, when assembled, there is no gap between the outer edges of tray 20 and walls of base box 40. This is accomplished in part by the combination of several characteristics of packaging 10: tray 20 is slightly oversized relative to the dimensions of cavity 405 of base box 40, support structure is slightly undersized relative to the dimensions of tray 20 and cavity 405, and edges of tray 20 extend and terminate perpendicularly at side walls 401/402/403/404 of base box 40. Therefore the edges of tray 20 so they press sharply against side walls 40 in an interference fit, eliminating any gaps. More specifically; FIG. 2 includes: dimension D1, measured from the inner surface of opposing sidewalls of base box 40; dimension D2, measured from the corresponding outer surfaces of opposing sidewalls of support structure 30; and dimension D3, measured from the corresponding opposing outer edges of tray 20. The sizing of these opposing dimensions results in no gap between the outer edges of tray 20 and walls of base box 40. For example, D3 may be oversized by a small amount, such as between approximately 0.1 and 0.7 mm relative to D1; D2 may be undersized by a small amount, such as between approximately 0.5 mm relative to D1. In this regard, when assembled, the base box 40 is held tightly around outer periphery of tray 20, both by the oversizing of the tray periphery, as well as undersizing of the support structure to allow for tight contact between edges of tray 20 and sidewalls 401/402/403/404 of base box 40. These dimensions may be referred to as "free lengths", in that they are distances between components that may change based on tension or compression being applied to the component in a non-free state. These dimensions are useful in denoting the gapless configuration and structural configuration of the packaging 10.

Tray 20 may be made of molded fiber. If support structure 30 were omitted, tray 20 would need to be sized larger in order to provide additional structure and strength for use in packaging 10. However, making large, heavy components with various molded recesses out of molded fiber increases the manufacturing time and material required, which drives up cost. At the same time yield is decreased, further increasing cost. However, if tray 20 is optimized to a minimal thickness, once laminated to a comparatively low-cost understructure like greyboard or corrugated cardboard (e.g., adhered to the top surface 308 of support structure 30) to compensate for reduced molded-fiber pulp and structure, significant throughput and cost savings are realized. Because both materials are cellulose-based materials (e.g., material formed of dried cellulose pulp), and the other components such as the base box 40 and lid 41 may also be composed of cellulose-based materials such as paperboard (e.g., folded paperboard), packaging 10 may still be recycled in a single stream recycling process without the need for additional pre-processing or sorting, thereby promoting ecological benefits.

The packaging components may be composed of a recyclable material (e.g., a biodegradable or compostable material). If and when the customer opts to dispose of the packaging, because the entire packaging (including the support structure 30) is recyclable and cellulose-based, the packaging may simply be recycled without requiring material separation (e.g., in a single-stream recycling program).

Turning to FIG. 4, an exaggerated cross-sectional view is shown, showing that D3 is clearly oversized, and D2 is clearly undersized. In reality, the dimensional variation of the angle of sidewalls 401/402/403/404 of base box 40 may be imperceptible to a customer. Moreover, depending on the overall dimensions of the packaging 10 and materials selected, these interference dimensions may be varied. As shown in FIG. 4, the walls of support structure 30 constrain sidewalls of base box 40 and inhibit bowing. Support structure 30 thus acts as a strut to hold sidewalls 401/402/403/404 of base box 40 firmly against the peripheral edges of tray 20, through adhesive 50, e.g., pressure sensitive adhesive.

Figure 5:
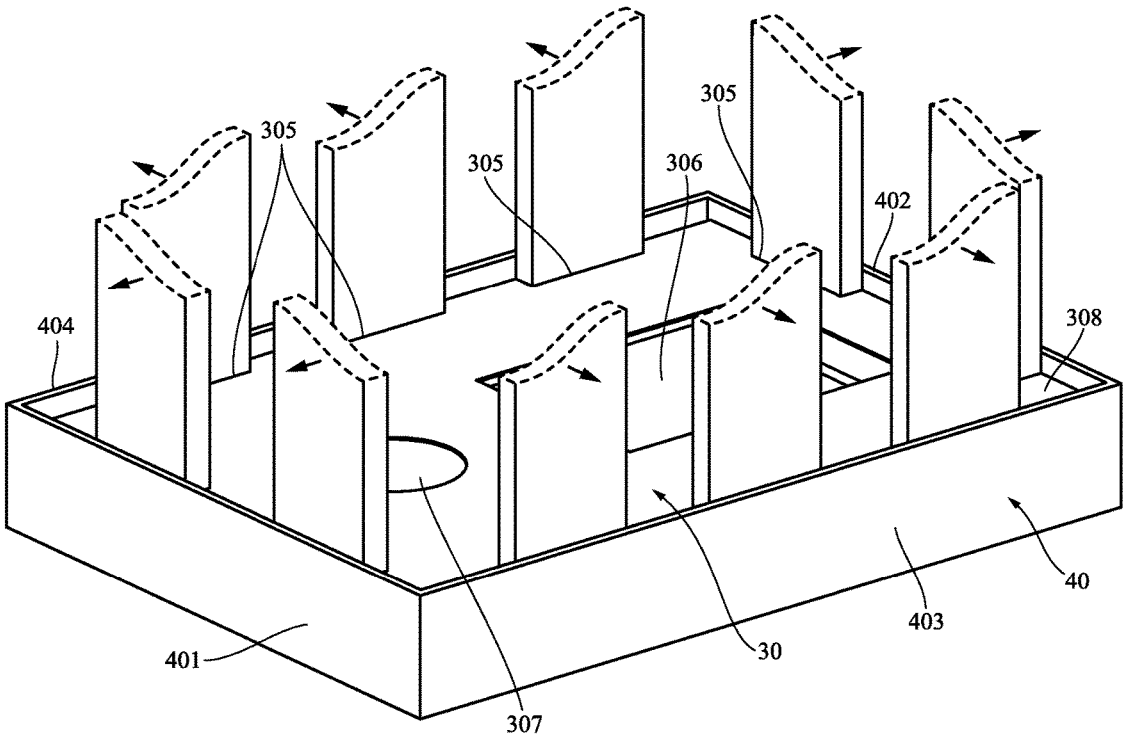
FIG. 5 shows the portion of the packaging shown in FIG. 2 with a schematic assembly jig for assembling the portion of the packaging.

Using cutouts 305 in the top surface 308 of support structure 30, a pressing fixture can be used to effect an adhesive bond between the sidewalls of support structure 30 and sidewalls of box 40. Turning to FIG. 5, representative fixtures with process arrows are shown. The fixture pulls the sidewalls 301/302/303/304 of support structure 30 outward, pressing pressure sensitive adhesive 50 against the inner surfaces of sidewalls 401/402/403/404 of base box 40. In some embodiments, the outer surfaces of the sidewalls of base box 40 can be surrounded or held in place to provide an opposing force, in addition to the structural force provided by the rigidity of base box 40. In this way, substantial pressure can be applied evenly between sidewalls 301/302/303/304 and sidewalls 401/402/403/404 while support structure 30 is assembled together and within base box 40, including pressure sufficient to activate adhesive 50, where adhesive 50 is a pressure sensitive adhesive.

Figure 6:
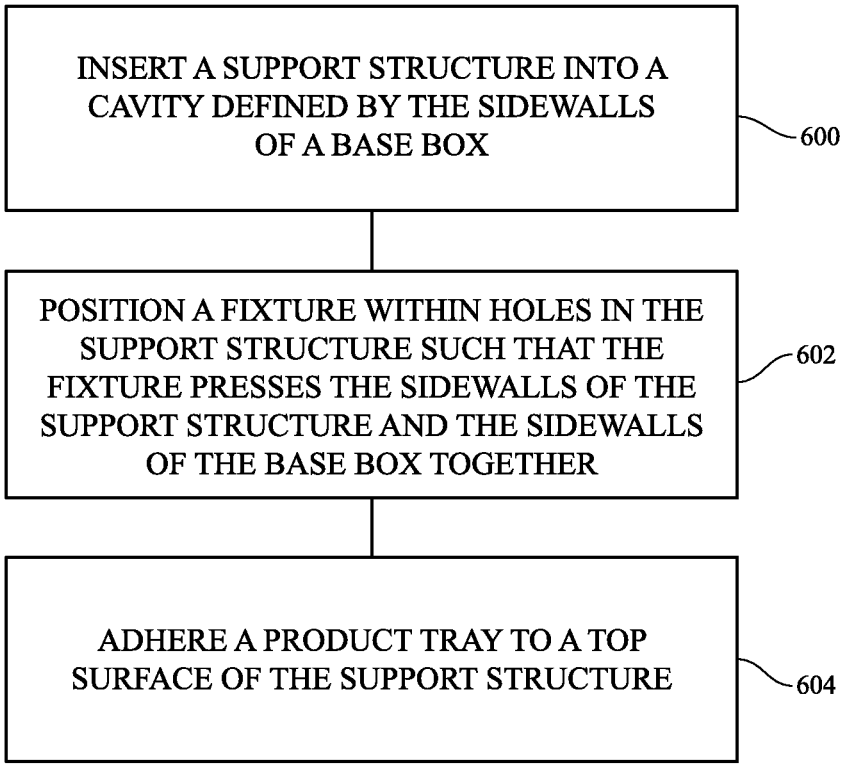
FIG. 6 shows a flowchart of a method of making packaging.

Turning to FIG. 6, a flowchart of a method of constructing packaging 10 is shown. The method steps may include insertion step 600 inserting a support structure into a cavity defined by the sidewalls of a base box. An outer periphery of the support structure is smaller than an inner periphery of the cavity, and the sidewalls of the support structure include pressure sensitive adhesive on their outer surfaces. The method includes positioning step 602, positioning a fixture within holes in the support structure such that the fixture presses the sidewalls of the support structure and the sidewalls of the base box together this activates the pressure sensitive adhesive and secures the support structure and base box together. The method includes step 604 adhering a product tray to a top surface of the support structure, e.g., with a water-based adhesive. The outer periphery of the tray is larger than the inner periphery of the cavity, such that there is no gap between the outer periphery of the tray and the inner periphery of the cavity.

Advantageously, this improves upon prior systems having, for example, folded trays or bowed lower base boxes, which produce gaps between the components that may provide an unfinished or disjointed appearance. By designing the relative dimensions between the corresponding features of the base box 40, support structure 30, and tray 20, product, assembly, or packaging tolerance issues still result in secure packaging having a gapless appearance.

Packaging 10 is constructed to give a clean, unitary appearance. This helps to reinforce its high quality and robust character, and that of the product 100. To achieve this appearance, seams, gaps, and raw material edges are minimized (raw material edges are edges formed by cutting through a flat material, where the substance of the material between its outer flat surfaces is revealed). Packaging 10 may be a particular color, e.g., a brand-identifier color. In some embodiments, visible surfaces of packaging 10 may be predominantly white, a color that cannot easily be achieved in recyclable cellulose-based materials, particularly in lessexpensive common greyboard or corrugated cardboard such as that which may form hidden support structure 30. In some embodiments, components of the packaging may be folded from one or more sheets, such that when folded over and adhered together there is no raw edge on the outside of the component or packaging TO. In some embodiments, components of packaging 10 may be constructed with multiple blanks.

Components of packaging 10, such as support structure 30, base box 40 and lid 41, may be formed from one or more blanks. In some embodiments, the blank is formed of a single continuous substrate, such as, for example cellulose-based material like cardboard or paperboard. In general, lower cost and robust material such as corrugated cardboard or greyboard is used for support structure 30, which may be formed from one or more blanks. In some embodiments, interior surfaces of the blanks may be surface treated or coated, for example with a coating to protect the finished component such as tray 20, or product 100. Tabs, flaps, and regions without adhesive of the blank are folded such that no adhesive is visible in finished packaging 10. In some embodiments, adhesive may be omitted and the various flaps and tabs attached in another suitable manner (e.g., by mechanical interlock or press fit). Fold lines may be formed, for example, by weakening the substrate along the lines, such as by perforation, material crushing, scoring, miter cutting, etc.

In some embodiments, any surface finishing may take place after the components are cut from the blank, or alternatively prior to the blank being cut into separate sheets for assembling to a final product. Additionally, some operations may be performed concurrently.

Alternatively, some or all of the components described as being formed of cellulose-based material, such as cellulose fiber material like paper, may instead be formed of a polymeric material. Suitable polymeric materials include, but are not limited to, polyethylene, polypropylene, polyurethane, polystyrene, polymer blends including one or more of these polymers, or co-polymers including one or more of these polymers. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet or roll of material). Single integrally-formed pieces of material that are cut by a single cutting operation may facilitate efficient and reproducible manufacturing. Moreover, such manufacturing may reduce waste by reducing waste material during manufacturing.

As used herein in association with a value, "approximately" denotes +/−10% of the value given.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. Packaging, comprising:

a base box comprising opposing sidewalls that define a first free length therebetween;

a molded-fiber tray disposed between the opposing sidewalls and below a top edge of the base box, wherein opposing edges of the tray define a second free length therebetween that is greater than the first free length such that the opposing edges are in contact with the opposing sidewalls; and a corrugated cardboard support structure disposed between the opposing sidewalls of the base box, wherein the support structure comprises a top surface fixed to the tray and opposing sidewalls connected to the top surface, wherein the sidewalls are spaced apart by a third free length at their connection to the top surface, and wherein the third free length is less than the first free length, and wherein inner surfaces of the opposing sidewalls of the base box and outer surfaces of the opposing sidewalls of the support structure are fixed together such that the opposing sidewalls of the base box are pulled against the opposing sidewalls of the support structure.

2. The packaging of claim 1, wherein the support structure comprises a pillar beneath a portion of the tray such that the tray is supported at the pillar and the tray's resistance to deflection is thereby increased.

3. The packaging of claim 1, wherein the tray and the base box wholly envelop the support structure such that it is not visible.

4. The packaging of claim 1, wherein there are no gaps between the tray and the sidewalls of the base box.

5. Packaging, comprising:

a base box having sidewalls defining a cavity;

a support structure having sidewalls disposed in the cavity, the support structure sidewalls being adhered to the sidewalls of the base box; and a tray disposed within the cavity, spaced below an upper edge of the base box and spaced above a bottom surface of the cavity, wherein the tray is adhered to the support structure, and wherein the tray is in contact with the sidewalls of the base box, wherein the tray and base box together hide the support structure from view, and wherein the support structure and tray are formed of different cellulose-based materials.

6. The packaging of claim 5, wherein the tray is molded fiber, and wherein the support structure is corrugated cardboard.

7. The packaging of claim 5, wherein the tray is supported in position relative to the base box by the sidewalls of the base box and by the support structure.

8. The packaging of claim 5, wherein the support structure comprises a pillar extending below a top surface of the support structure, the pillar contacting a lower surface of the base box such that resistance to bending of the top surface of the support structure is increased.

9. The packaging of claim 5, wherein an outer periphery of the tray is larger than an inner periphery of the cavity, such that the outer periphery of the tray presses against the inner periphery of the cavity so that there are no gaps between the tray and the sidewalls of the base box.

10. The packaging of claim 5, wherein an outer periphery of a top surface of the support structure is smaller than an inner periphery of the cavity, such that the adhesion between the sidewalls of the support structure and the side walls of the base box results in a tension fit that pulls the sidewalls of the base box against the tray so that there are no gaps between the tray and the sidewalls of the base box.

11. The packaging of claim 5, wherein the support structure defines cutouts in the top surface from which the sidewalls extend, and wherein the cutouts are configured to receive a pressing fixture to press the sidewalls of support structure and sidewalls of the base box together to effect an adhesive bond therebetween.

12. The packaging of claim 5, wherein the tray comprises a recess to receive a second product, and wherein the support structure comprises a corresponding hole to accommodate the recess when the tray is positioned above the support structure.

13. The packaging of claim 5, wherein the support structure comprises a single continuous sheet of corrugated cellulose-based material.

14. The packaging of claim 5, wherein the entirety of the packaging is formed of cellulose-based material.

15. Packaging, comprising:

a base box comprising vertical sidewalls;

a molded-fiber tray interference fit with the vertical sidewalls below a top edge of the base box such that edges of the tray are in contact with the vertical sidewalls; and a support structure disposed under the tray, wherein the support structure comprises:

a pillar extending below a top surface of the support structure, the pillar contacting a lower surface of the base box such that resistance to bending of the top surface of the support structure is increased; and sidewalls that are adhered to the sidewalls of the base box and thereby pull the sidewalls of the base box against the edges of the tray to help maintain the interference fit and eliminate any gaps between the base box and the tray.

16. The packaging of claim 15, wherein the vertical sidewalls comprise first opposing sidewalls that define a first free length therebetween and second opposing sidewalls that define a second free length therebetween, wherein first opposing edges of the tray define a third free length therebetween that is greater than the first free length and wherein second opposing edges of the tray define a fourth free length therebetween that is greater than the second free length, and wherein the first opposing edges are in contact with the first opposing sidewalls and wherein the second opposing edges are in contact with the second opposing sidewalls.

17. The packaging of claim 16, wherein the difference between the first free length and the third free length is between approximately 0.1 mm and 0.7 mm.

18. The packaging of claim 16, wherein the sidewalls of the support structure comprise opposing sidewalls that define a fifth free length, and wherein the fifth free length is less than the first free length.

19. The packaging of claim 18, wherein the difference between the first free length and the fifth free length is approximately 0.5 mm.

20. The packaging of claim 18, wherein the support structure and the tray are formed of different cellulose-based materials.

* * * * *